US006250881B1

(12) United States Patent
Mordue et al.

(10) Patent No.: US 6,250,881 B1
(45) Date of Patent: Jun. 26, 2001

(54) MOLTEN METAL SHAFT AND IMPELLER BEARING ASSEMBLY

(75) Inventors: George S. Mordue, Ravenna; Richard S. Henderson, Solon, both of OH (US)

(73) Assignee: Metaullics Systems Co., L.P., Solon, OH (US)

( * ) Notice: Subject to any disclaimer, the term of this patent is extended or adjusted under 35 U.S.C. 154(b) by 577 days.

(21) Appl. No.: 08/651,571

(22) Filed: May 22, 1996

(51) Int. Cl.[7] ..... F04D 7/06

(52) U.S. Cl. ..... 415/200; 415/170.1; 415/172.1; 415/216.1; 415/229; 415/217.1; 416/174

(58) Field of Search ..... 415/88, 200, 11, 415/170.1, 171.1, 172.1, 216.1, 217.1, 229; 416/174, 241 R, 241 A; 266/235, 239; 403/364, 381; 156/91, 293, 294; 285/172, 290

(56) References Cited

U.S. PATENT DOCUMENTS

| | | | | |
|---|---|---|---|---|
| 3,048,384 | * | 8/1962 | Sweeney et al. | 415/200 |
| 5,028,211 | * | 7/1991 | Mardue et al. | 416/204 R |
| 5,203,681 | * | 4/1993 | Cooper | 415/200 |
| 5,336,351 | * | 8/1994 | Meyers | 156/294 |
| 5,470,201 | * | 11/1995 | Gilbert et al. | 415/200 |
| 5,597,289 | * | 1/1997 | Thut | 415/200 |

FOREIGN PATENT DOCUMENTS

| | | | | |
|---|---|---|---|---|
| 0164525 | * | 7/1987 | (JP) | 156/293 |

* cited by examiner

*Primary Examiner*—Christopher Verdier
(74) *Attorney, Agent, or Firm*—Fay, Sharpe, Fagan, Minnich & McKee, LLP

(57) ABSTRACT

A molten metal impeller having a base portion including a circumferential notch. The notch having a generally radial wall and a generally axial wall, at least one of the radial or axial walls including a plurality of grooves. A ceramic bearing ring is cemented into the notch.

19 Claims, 7 Drawing Sheets

MOLTEN METAL SHAFT AND IMPELLER BEARING ASSEMBLY

FIELD OF THE INVENTION

This invention relates to molten metal pumps. More particularly, this invention relates to a new and improved shaft and impeller assembly for use in molten metal pumps. In particular, the invention relates to a new and improved means for attaching a bearing ring to a shaft and/or impeller for use in a molten metal pump.

The inventive means for attaching a bearing ring to the shaft and impeller is particularly suited to use in molten metal circulation, transfer, and gas injection pumps. Throughout the specification, numerous references will be made to use of the new design in molten aluminum and zinc pumps, and certain prior art molten aluminum and zinc pumps will be discussed. However, it should be realized that the invention could be used in a variety of molten metal environments wherein a bearing ring is secured to a rotating shaft or impeller.

DESCRIPTION OF THE ART

Molten metal pumps are typically comprised of at least a motor positioned outside of the molten metal environment having a rotatable shaft extending downwardly into the molten metal. An impeller is attached to the submerged end of the shaft and is typically encased in a pump housing. Rotation of the impeller within the pump housing draws molten metal into an inlet and forces the molten metal through an outlet. To achieve stable rotation of the impeller, the impeller and often the shaft, are journaled with a bearing against the pump housing and/or components attached thereto.

Historically, one of the weakest components of a molten metal pump has been the shaft and impeller assembly. Particularly, these dynamic elements of the pump are subjected to corrosion, oxidation and often ingest large pieces of slag or dross which impact the impeller and shaft with significant force. To resist oxidation and corrosion in the high temperature environment, the shaft and impeller assemblies are typically constructed of a refractory material such as graphite. However, graphite is also a soft material which will quickly wear away in a pump environment. Accordingly, a bearing surface is typically provided. The bearing surface generally is created by placing a bearing ring on the impeller and a bearing set on the pump housing.

Notwithstanding the hostile environment, recent developments in coupling and drive designs, enhanced shaft to impeller attachment mechanisms, improved graphite oxidation resistance and high performance ceramic protection sleeves have significantly lengthened the life span of the shaft impeller assembly. Therefore, the attachment of a ceramic bearing ring to the impeller, and optionally to the shaft, remains one of the most common points of failure in the entire assembly.

Historically, a bearing ring is cemented to the shaft and impeller. Particularly, a typical impeller has a generally cylindrical portion which is machined to include a notched periphery, and the bearing ring—often of silicon carbide—is cemented into the notch. In certain designs, the radially facing wall of the notch has been canted inwardly, toward the rotational axis, in the direction of the intersection with the axial facing wall. However, the prior art designs have remained a frequent area of failure because the joint is incompletely filled with cement and the graphite to cement adherence is relatively poor.

To increase the operable life of a molten metal pump and to increase its overall reliability, it is desirable in this art to improve the means for attachment of the bearing ring to the impeller and shaft assemblies.

SUMMARY OF THE INVENTION

Accordingly, it is a primary object of this invention to provide a new and improved mechanism to secure a bearing to a molten metal impeller and/or shaft.

It is an advantage of this invention to provide an improved joint between an impeller and bearing ring which experiences significantly less degradation and/or breakage.

A still further advantage of this invention is that the improved joint between the bearing ring and the impeller and/or shaft is achieved through inexpensive machining requiring only a simple turning operation.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the present invention is comprised of a molten metal impeller having a body shaped to draw metal through an inlet of a pump housing and expel molten metal through an outlet of the pump housing. The impeller includes a bearing adhesively attached to at least an effective portion of the periphery of the impeller. The improvement in the design is based upon the inclusion of at least one or a plurality of generally concentric grooves on the surface of the impeller adjacent the location of the bearing ring. In a particularly preferred embodiment of the invention, the plurality of concentric grooves are formed by a single or cooperate set of spiraling channel(s).

The invention is particularly directed to molten metal impellers having a generally circular base or top portion surrounded by a bearing ring and a plurality of vanes extending from the circular portion. Preferably, the impeller will be comprised of graphite and the bearing ring comprised of silicon carbide and the adhesive used to attach the bearing ring to the impeller is a refractory cement.

In a particularly preferred form of the invention, a cylindrical impeller will include a notch having a radially facing wall and an axially facing wall around the entire circumference of one end. In a first embodiment thereof, only the radially facing wall will include a plurality of grooves. In a particularly preferred version, both axial and radial walls will include grooves. Preferably, these grooves will cover the entire circumference of the wall. Preferably, the grooves will have a depth in excess of twice the thickness of the cement joint.

BRIEF DESCRIPTION OF THE DRAWINGS

The invention consists of the novel parts, construction, arrangements, combinations and improvements shown and described. The accompanying drawings, which are incorporated in and constitute a part of the specification illustrate one embodiment of the invention, and together with a description, serve to explain the principals of the invention. In the drawings.

DETAILED DESCRIPTION OF THE INVENTION

Reference will now be made in detail to the present preferred embodiments of the invention, examples of which are illustrated in the accompanying drawings.

While the invention will be described in connection with preferred embodiments, it will be understood that it is not intended to limit the invention to those embodiments. On the contrary, it is intended to cover all alternatives, modifications and equivalents that may be included within the spirit and scope of the invention defined by the appended claims.

Figure 1:
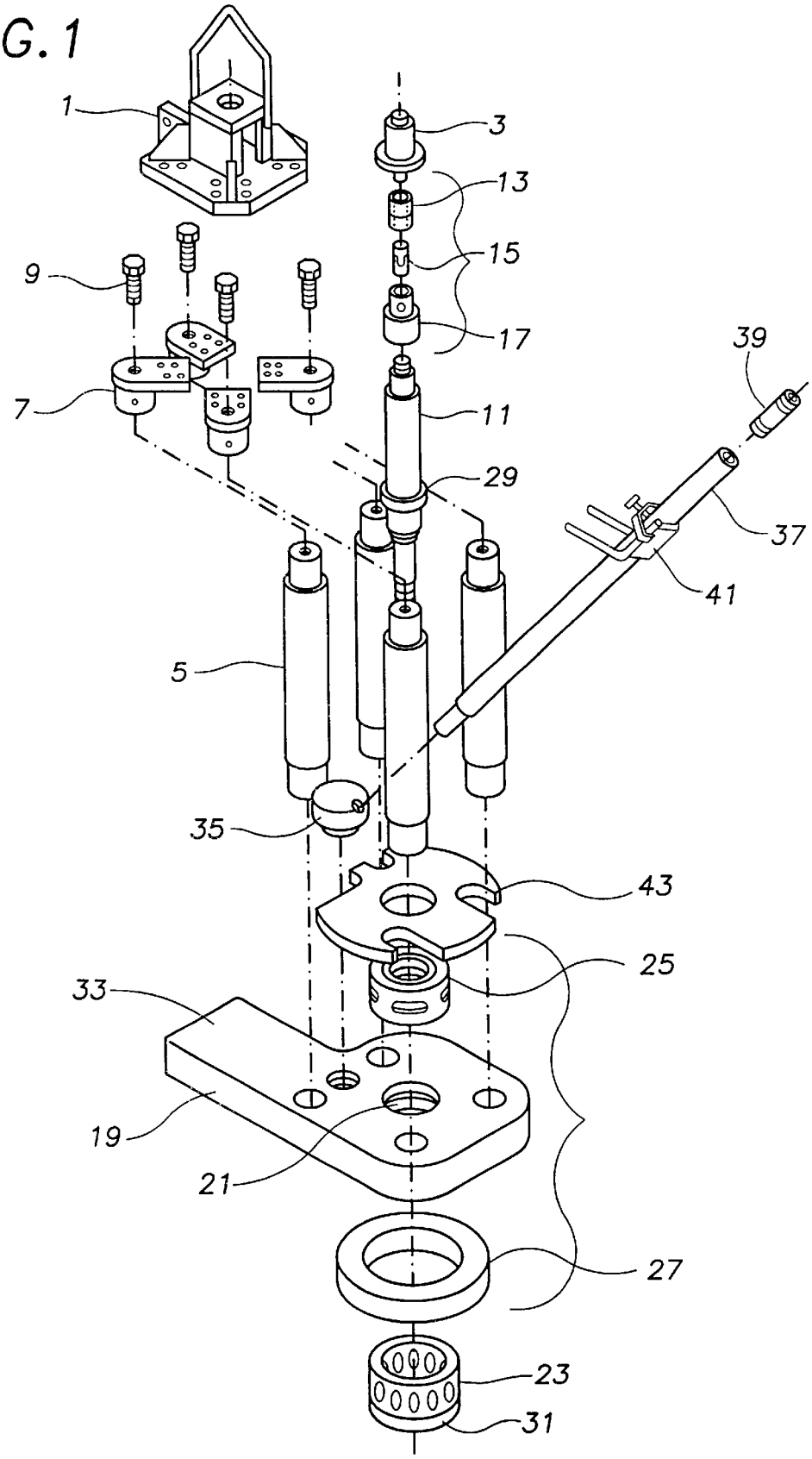
FIG. 1 is a diagrammatic view of a molten metal pump for which the inventive impeller and shaft design is suited.

Referring now to FIG. 1, a typical molten metal pump, in this instance a gas injection pump, for which the present inventive bearing joint is suitable is depicted. The pump is generally comprised of a hanger/motor mount assembly 1 and a motor 3. The motor mount 1 is secured to posts 5, comprised of a refractory material, by a plurality of sockets 7 and bolts 9. The motor is secured to refractory shaft 11 by a coupling assembly comprised of motor coupling 13, universal joint 15 and shaft coupling 17. Posts 5 are secured to pump housing 19 by refractory cement and shaft 11 extends into pumping chamber 21 thereof. Shaft 11 is secured to a molten metal impeller 23 rotatable within pumping chamber 21. Pump housing 19 includes a shaft bearing mount with bearing set 25 and a base bearing set 27. In an assembled form, bearing ring 29 on the shaft and bearing ring 31 on the impeller are journaled by shaft bearing set 25 and base bearing set 27 respectively to secure the shaft and impeller during high speed rotation.

During rotation of impeller 23, molten metal is drawn into pumping chamber 21, in this instance, through the top and discharged through snout 33 of pump housing 19. Since the pump has a top inlet, a baffle plate 43 is included to reduce the likelihood of ingestion of solid objects which could clog or destroy the rotating impeller. As stated, the molten metal pump depicted in FIG. 1 is a gas injection model, and therefore includes injection tube plug 35, injection tube 37, injection tube nipple 39 and injection tube clamp 41.

Figure 3:
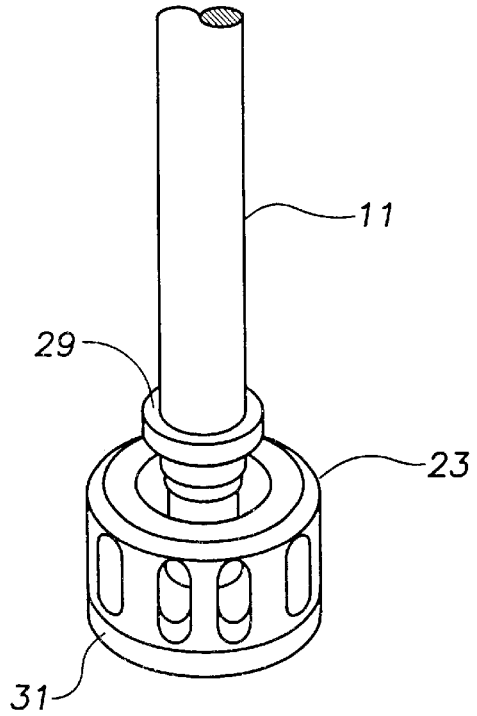
FIG. 3 is a perspective view of a impeller and shaft assembly, generally of the type in FIG. 1, incorporating the inventive bearing joint.

FIG. 3 generally depicts the impeller of the type shown in FIG. 1, wherein shaft 11, including bearing 29, is secured to impeller 23, including bearing ring 31.

Figure 2:
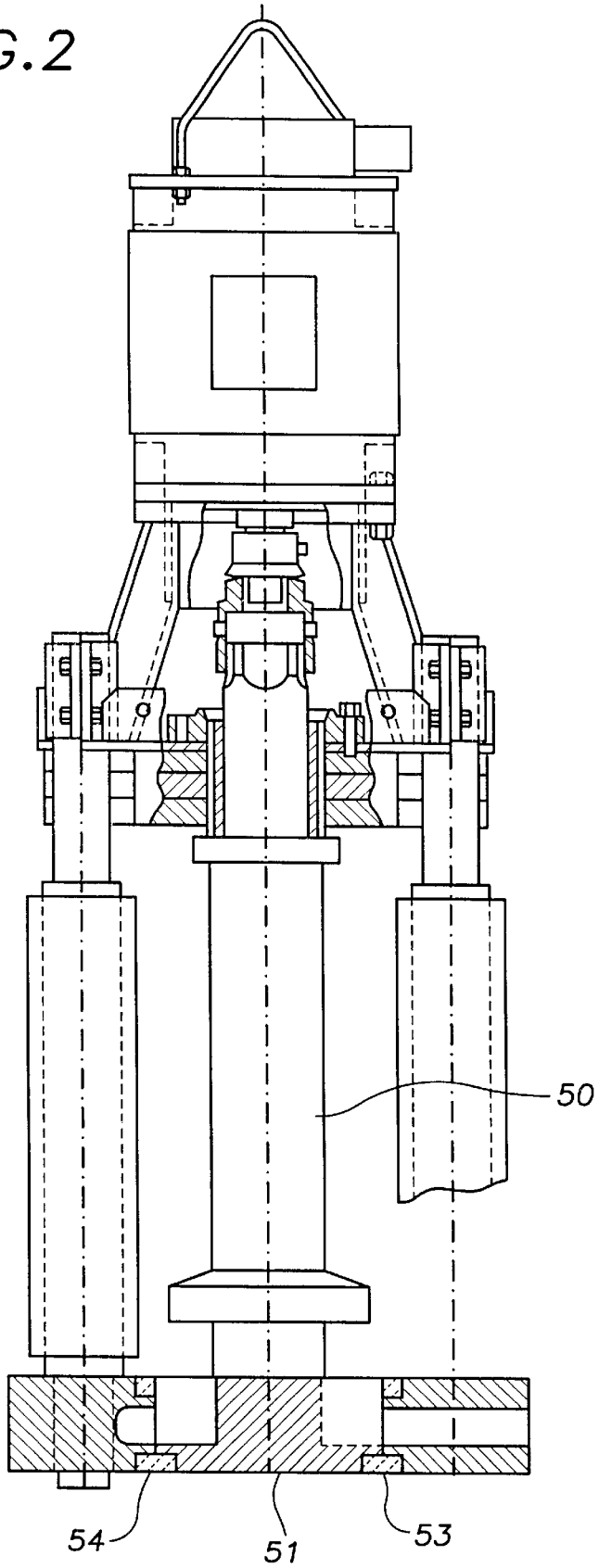
FIG. 2 is an elevation view, partially in section, of an alternative molten metal pump for which the present invention impeller design is suited.
Figure 4:
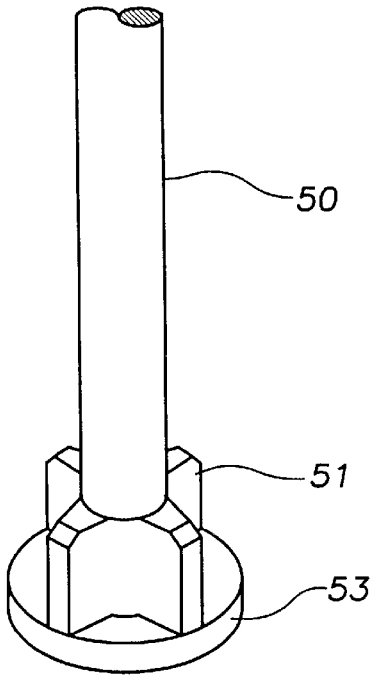
FIG. 4 is a perspective view of an alternative impeller and shaft assembly, generally of the type in FIG. 2, incorporating the inventive bearing joint.

Referring now to FIG. 2, an alternative type of molten metal pump, in this case a circulation pump, is depicted. In this instance, impeller 51 is a bladed impeller attached to shaft 50 and includes a bearing ring 53 secured to the periphery of its base portion, opposed by bearing set 54. FIG. 4 generally depicts the impeller of the type shown in FIG. 2, wherein shaft 50 is secured to impeller 51 having bearing ring 53.

Figure 5:
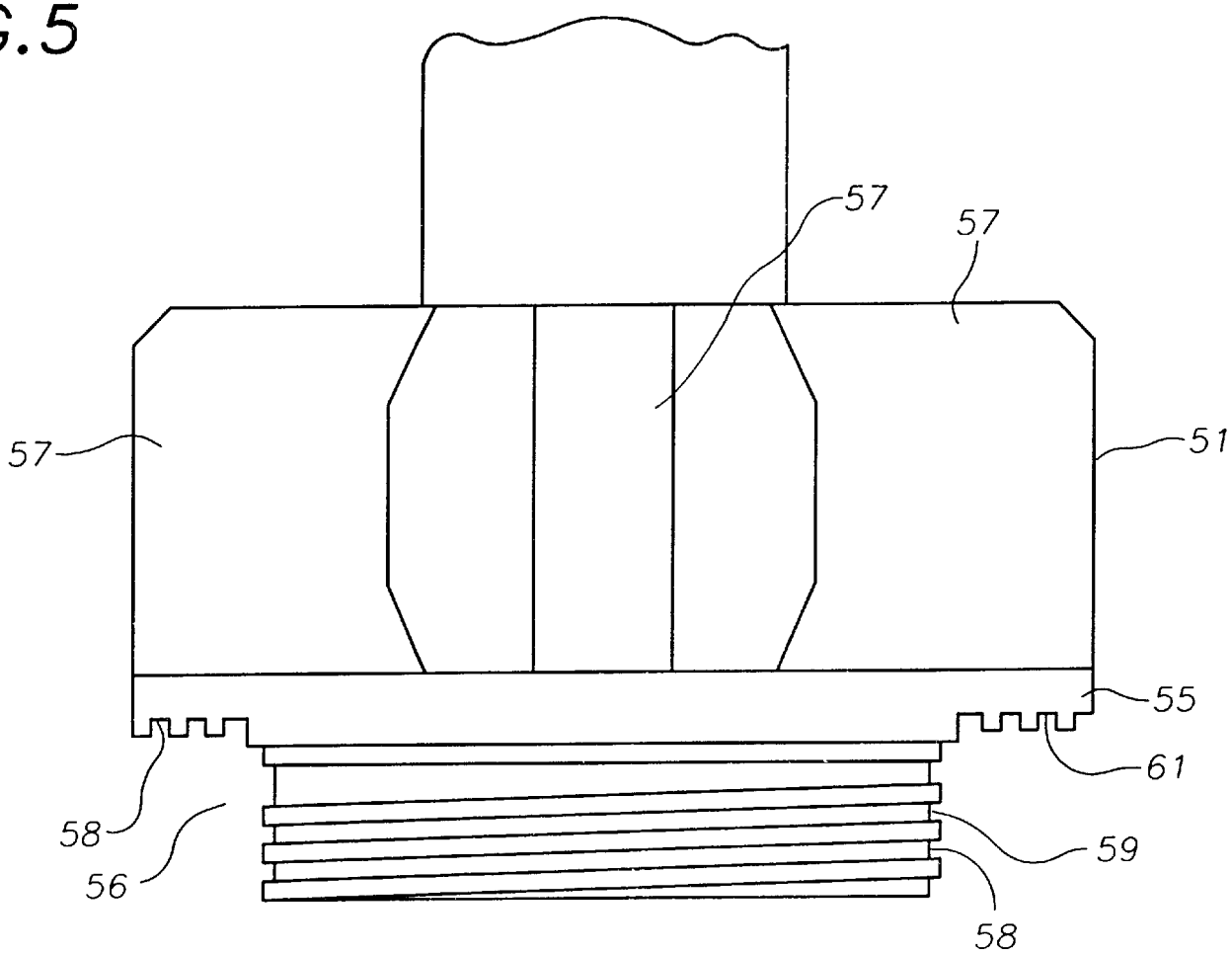
FIG. 5 is a partial elevation view of the impeller of FIG. 4 having the bearing ring removed.

Referring now to FIG. 5, the notch 56 of impeller 51 which accommodates a bearing ring (not shown) is depicted. Impeller 51 includes a base portion 55 and a plurality of vanes 57 extending therefrom. The generally circular base 55 includes peripheral notch 56 at its lower most portion and is sized appropriately to accommodate a bearing ring (not shown). Radially facing wall 59 of the notch and axially facing wall 61 of the notch include a plurality of grooves 58, however, the inventive design includes an impeller having only one grooved wall.

It has been found that the grooved walls facilitate even disbursement of a cement, for example Frakset cement available from Metaullics Systems, Co. L.P., over the entire joint surface. In addition, the grooved graphite surface provides improved mechanical bonding at the graphite/refractory cement interface.

As noted earlier, the impeller/bearing ring joint has been a persistent problem in operation of metal pumps. However, the inventors have found that securing a bearing ring to an impeller in the fashion described herein surprisingly results in a bearing ring which cannot be removed—after cement curing—through repeated striking with a hammer. Moreover, striking of an impeller/bearing arrangement constructed in accord with the inventive design usually results in only chipping of the bearing ring and no cracking of the cement joint.

Figure 6:
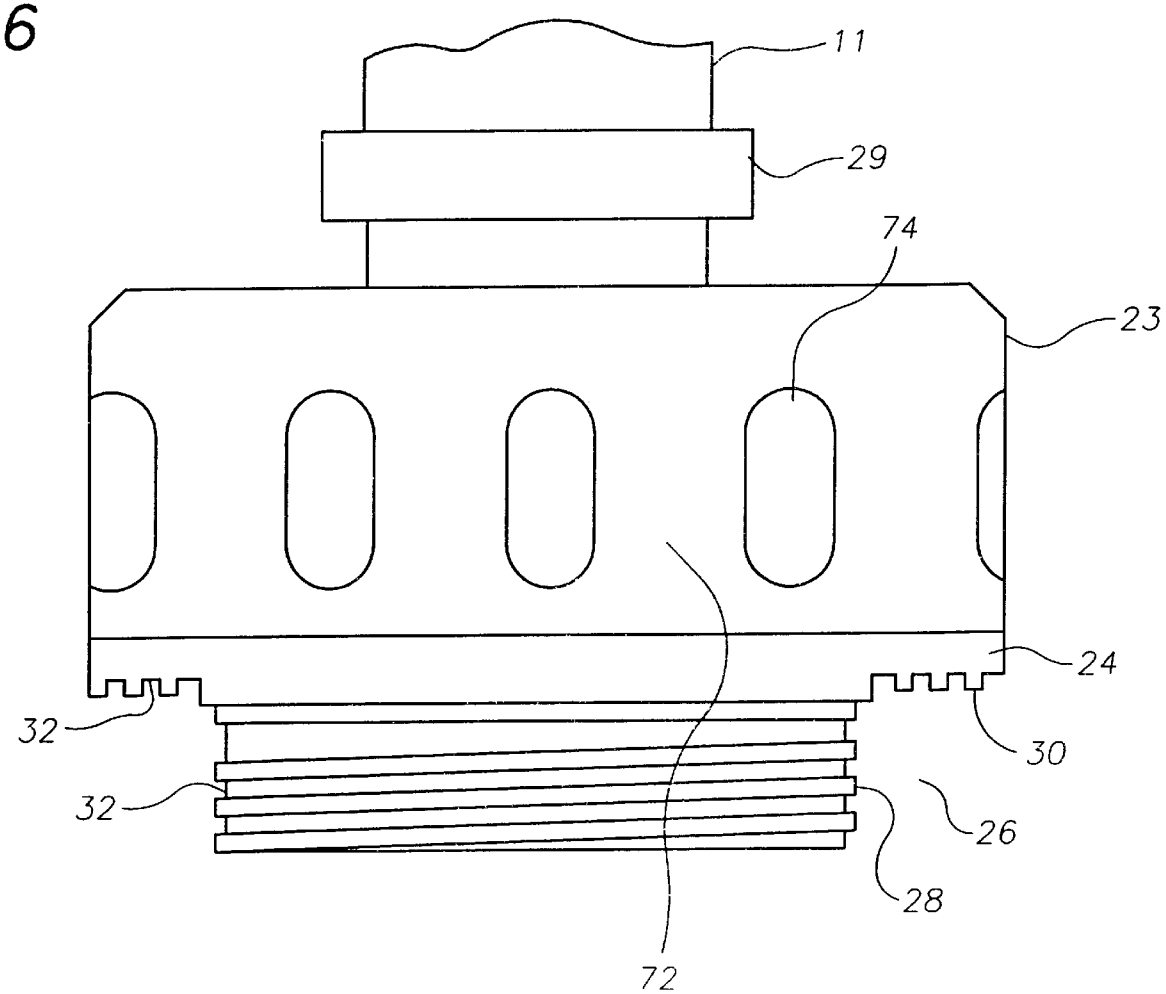
FIG. 6 is a partial elevation view of the impeller of FIG. 3 having the bearing ring removed.

Referring now to FIG. 6, impeller 23 and shaft 11 are depicted. In this instance, the impeller includes a base portion 24, generally circular in shape, having a bird cage structure with a plurality of vanes 72 separated by oval passages 74, extending perpendicular therefrom. Again, the impeller base 24 includes a notch 26 at its lower most periphery. More particularly, notch 26 is formed by a radial wall 28 and an axial wall 30, each having grooves 32. In this embodiment, as opposed to the embodiment of FIG. 5 wherein a plurality of concentric grooves are formed, the grooves of FIG. 6 are formed as a single spiraling channel. Importantly, when cement is placed on the grooved surface and the impeller fitted thereto, rotation of the impeller results in "pumping" of the cement throughout the joint. Moreover, a clockwise rotation of the impeller in combination with the spiraling groove 32 results in a pumping of the cement inwardly along radial face 30 and downwardly along axial face 28.

Figure 7:
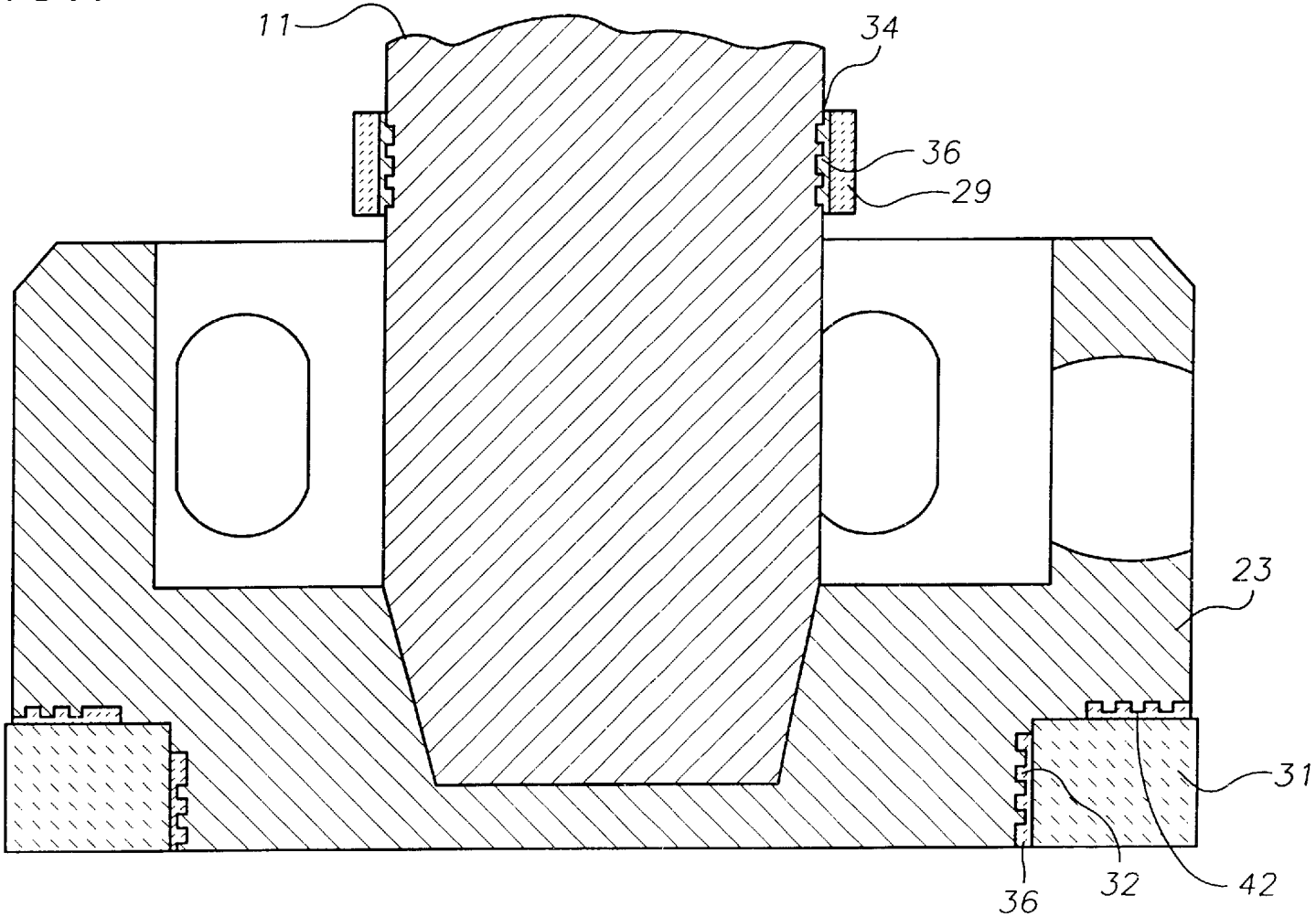
FIG. 7 is a cross-sectional view of the impeller of FIG. 3.
Figure 8:
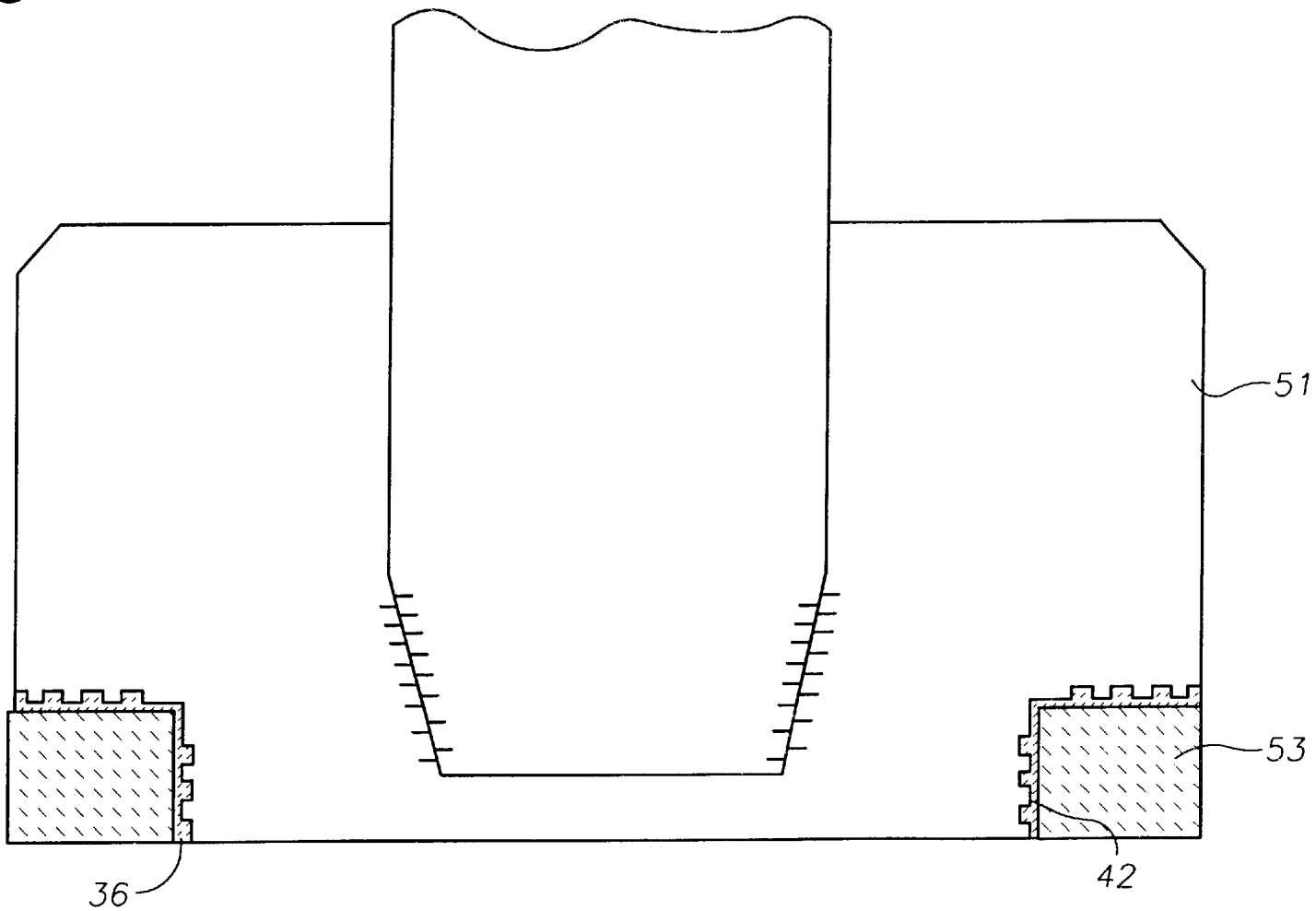
FIG. 8 is a cross-sectional view of the impeller of FIG. 4.

FIG. 7 depicts the impeller of FIG. 6 wherein a grooved surface 34 is formed on shaft 11 and filled by cement 36 to secure bearing ring 29 thereto. Referring to impeller 23, cement 36 forms a joint 42 with bearing ring 31. Preferably, the grooves 32 have a depth in excess of the thickness of joint 42, more preferably at least twice the depth of the joint thickness. With reference to FIG. 8, bearing ring 53 is secured by cement 36 creating a joint 42 with impeller 51.

The invention is not limited to the impeller designs depicted herein. Moreover, the invention is envisioned as being suited to any molten metal impeller design wherein a bearing is secured to the impeller. For example, the impellers and pumps disclosed in U.S. Pat. Nos. 3,836,280; 5,028,211; 4,786,230; 5,203,681; 5,470,201; 5,078,572; 2,948,524; 3,048,384; 4,940,384 would benefit from the inventive joint design disclosed and those patents are herein incorporated by reference. Accordingly, the skilled artisan will note that the invention is not limited to a particular impeller design. Rather, the invention is directed to a mechanism for attachment of a bearing material to a molten metal impeller of any design.

Thus, it is apparent that there has been provided, in accordance with the invention, a molten metal impeller and/or shaft bearing joint that fully satisfies the objects, aims and advantages set forth above. While the invention has been described in conjunction with the specific embodiments thereof, it is evident that many alternatives, modifications, and alternatives will be apparent to those skilled in the art in light of the foregoing description. Accordingly, it is intended to embrace all such alternatives, modifications and variations as fall within the spirit and broad scope of the appended claims.

What is claimed is:

1. A molten metal impeller comprised of a base portion having vanes extending therefrom, said base portion including a first generally circular section and a second generally circular section of a reduced diameter positioned generally concentrically to the first and extending therefrom, a circumferential notch being formed by said first and second sections, said notch having a generally radial wall formed by said second section and a generally axial wall formed by said first section, at least one of said radial or axial walls including a plurality of grooves, said grooves containing a temperature resistant adhesive joining a bearing ring to said impeller.

2. The impeller of claim 1 wherein both said axial and said radial walls include grooves.

3. The impeller of claim 1 wherein said grooves extend throughout the entire circumference of said radial or axial wall.

4. The impeller of claim 1 wherein said plurality of grooves are formed from a single spiraling groove repeatedly covering the circumference of at least one of said radial or axial walls.

5. The impeller of claim 1 wherein said grooves have a depth of at least about twice the thickness of said adhesive joint.

6. The impeller of claim 1 being comprised of graphite.

7. The impeller of claim 1 wherein said bearing ring is comprised of silicon carbide.

8. A molten metal impeller comprised of a body shaped to draw molten metal through an inlet in a pumping chamber and expel molten metal through an outlet in said pumping chamber, a bearing ring cemented to at least an effective portion of the periphery of said impeller, wherein the improvement comprises a plurality of grooves on a surface of said impeller adjacent the location of said bearing ring such that the plurality of grooves are substantially filled with a cement to secure said bearing ring to said impeller.

9. The impeller of claim 8 being comprised of graphite.

10. The impeller of claim 8 wherein said bearing ring is comprised of silicon carbide.

11. The impeller of claim 8 wherein said plurality of grooves is at least two concentric grooves.

12. The impeller of claim 8 wherein said plurality of grooves is formed by at least one spiraling channel.

13. A molten metal impeller comprised of a generally circular base portion including a first and second surface and having vanes extending radially from said first surface, said circular base portion having a bearing ring adhesively attached to a periphery of said second surface, said periphery including at least one radially facing groove having a cross-sectional width which is smaller than a cross-sectional width of said bearing ring.

14. The impeller of claim 13 being comprised of graphite.

15. The impeller of claim 13 wherein said bearing ring is comprised of silicon carbide.

16. The impeller of claim 13 wherein said at least one radially facing groove is at least two concentric grooves.

17. The impeller of claim 13 wherein said at least one radially facing groove is formed by at least one spiraling channel.

18. A shaft for a molten metal impeller including an adhesively secured bearing ring, the improvement comprising a plurality of grooves on the surface of the shaft adjacent the bearing ring, the plurality of grooves receiving an adhesive for securing said bearing ring.

19. A molten metal impeller comprised of a base portion having vanes extending therefrom, said base portion including a first generally circular section and a second generally circular section of a reduced diameter positioned generally concentrically to the first and extending therefrom, a circumferential notch being formed by said first and second sections, said notch consisting of a generally radial wall formed by said second section and a generally axial wall formed by said first section, at least one of said radial or axial walls including a plurality of grooves, said grooves containing a temperature resistant adhesive joining a bearing ring to said impeller.

* * * * *